US007425152B2

(12) United States Patent
Hardt et al.

(10) Patent No.: US 7,425,152 B2
(45) Date of Patent: Sep. 16, 2008

(54) CABLE CONNECTING DEVICE

(75) Inventors: Falk Hardt, Münchberg (DE); Thorsten Rösch, Berlin (DE); Detlef Jegust, Berlin (DE)

(73) Assignee: GPH GmbH (DE)

( * ) Notice: Subject to any disclaimer, the term of this patent is extended or adjusted under 35 U.S.C. 154(b) by 0 days.

(21) Appl. No.: 10/479,386

(22) PCT Filed: May 29, 2002

(86) PCT No.: PCT/EP02/05929

§ 371 (c)(1),
(2), (4) Date: Jun. 16, 2004

(87) PCT Pub. No.: WO02/097928

PCT Pub. Date: Dec. 5, 2002

(65) Prior Publication Data

US 2004/0248465 A1 Dec. 9, 2004

(30) Foreign Application Priority Data

May 29, 2001 (EP) ..... 01113089

(51) Int. Cl.
*H01R 9/05* (2006.01)

(52) U.S. Cl. ..... 439/578

(58) Field of Classification Search ..... 439/469, 439/825, 578, 579, 583, 810, 877, 347, 346; 156/86; 174/80, 92, 89 R, 72 R, 73 R, 65 R; 385/135, 101, 75; 292/307
See application file for complete search history.

(56) References Cited

U.S. PATENT DOCUMENTS 3,609,657 A * 9/1971 Stanback ..... 439/814
4,223,179 A * 9/1980 Lusk et al. ..... 174/73.1
4,342,477 A * 8/1982 McClure ..... 292/307 R
4,634,213 A * 1/1987 Larsson et al. ..... 439/875
5,423,692 A 6/1995 Francis ..... 439/335
5,574,815 A * 11/1996 Kneeland ..... 385/101
5,793,920 A * 8/1998 Wilkins et al. ..... 385/135
5,825,961 A * 10/1998 Wilkins et al. ..... 385/135
5,951,337 A 9/1999 Brake ..... 439/825
6,071,145 A * 6/2000 Toly ..... 439/485
6,726,510 B2 * 4/2004 Norbert et al. ..... 439/810

* cited by examiner

FOREIGN PATENT DOCUMENTS

EP 0773601 5/1997 ..... 13/44

OTHER PUBLICATIONS

International Search Report dated Oct. 29, 2002.

*Primary Examiner*—Alexander Gilman
(74) *Attorney, Agent, or Firm*—Sofer & Haroun, LLP

(57) ABSTRACT

A cable connecting device includes a bush which has at least two cylindrical cavities, into which, in each case, a contact-making element can be inserted. The contact-making element has a contact sleeve and has maintains contact-making bands on its outer side and has a locking device which, after the contact sleeve has been inserted into the cavity, secures the contact sleeve in its place. The power cable is connected to the contact sleeve and clamped in the latter by means of at least two screws on the outer side, which can be screwed into the I wall of the contact sleeve, where the screws are distributed over the circumference of the contact sleeve along an imaginary spiral so that that they can be screwed onto the power cable at different angles around a central longitudinal axis of the sleeve relative to one another.

15 Claims, 3 Drawing Sheets

CABLE CONNECTING DEVICE

Related Application:

This application is a National Phase Application of PCT patent application No. PCT/EP02/05929, which claims priority to European Patent Application No. 01 113 089.5, filed on May 29, 2001.

Field of the Invention:

The present invention relates to a cable connecting device for fixing power cables and for producing an electrical connection between power cables.

Background:

Cable connecting devices of this type have to withstand extreme tensile forces, on account of the enormous thickness of the power cables to be connected, without their function being impaired.

FIG. 1 illustrates a normal cable connecting device for power cables according to the previously known prior art in a cross section. This is a plug-in contact fitting for Connex connecting systems for high-voltage cables, such as have been used in the power trade for a considerable time.

The cable connecting device 51 has a bush 52 into which two cavities 53 aligned on an axis are integrally molded and are separated only by an intermediate wall 63 present in the bush. The cavities 53 are cylindrical and are used to accommodate in each case a multi-part contact-making element 54, which is assembled from a contact sleeve 55 and a locking device 57. The contact sleeve 55 comprises a cone 62 which tapers toward the interior of the bush 52 and is provided with slits, and an outer ring 61 in whose outer side 60 contact-making bands 56 for producing the conductive connection with the walls of the bush 52 are introduced. Ring 61 and cone 62 are formed as separate parts, the ring 61 likewise being chamfered inward on its inner surface, in order to simplify the insertion of the cone 62 and ensure its fixing. During assembly, first of all the power cable (not shown) is inserted into the cone 62, where it is fixed lightly at its front end on account of the narrowing. The ring 61 is then pushed over the cone 62 and, together with the latter, inserted into the cavity 53. In order to anchor the power cable firmly and to produce an electrical connection to the bush, the required contact force is then transmitted to the cone 62 via the locking device 57 by means of a hydraulic tool. As a result, the cone 62 is displaced in the direction of the interior of the bush in such a way that it is compressed in the interior of the ring 61. This provides a secure connection, which can virtually no longer be released. Via the contact sleeve 55 and the contact-making bands 56 arranged thereon, an electrical connection is produced to the electrically conductive bush 52 and, at the same time, to the power cable arranged in the other cavity. However, the mounting of the power cable in the cable connecting device is relatively complicated and, and the same time, requires further additional tools or inserts. The device of the prior art also has disadvantages as a result of the fact that it can only be used to a very limited extent for cables of different cross sections.

U.S. Pat. No. 5,951,337 A discloses a connecting device for cable plugs, in particular for banana plugs, which has an electrically conductive bush with two mutually opposite cavities, into which the cable plugs can be inserted. The cable plugs are fixed there merely on account of the spring force of their spring elements, but can easily be pulled out again by manual actuation. This connecting device is therefore not suitable for power cables such as high-voltage cables.

U.S. Pat. No. 5,423,692 A discloses a connecting device between high-current cables and a connection. In this context, the high-current cable is firstly inserted into a cavity of a contact element constructed in the form of a bush and fixed there by means of two screws arranged along an envelope line of the bush. The electrically conductive bush is then plugged onto the connection in such a way that the associated pin can be fixed into a second cavity of the bush, which produces an electrical contact between connection and cable. For security, a nonconductive, rigid security sleeve is also pushed over the cable-side part of the bush and is fixed to the conductive bush by means of a pin.

Objects and Summary:

The present invention is based on the object of providing a cable connecting device for fixing power cables and for producing an electrical connection between power cables in which the mounting of the power cables proceeds particularly simply, which is simultaneously suitable for cables of different cross sections and ensures a reduction in the material costs.

The fact that the screws are distributed over the outer circumference of the contact sleeve in such a way that they can be screwed onto the power cable at different angles achieves particularly simple mounting and fixing of power cables. In particular, conductors with a small cross section or a non-round cross section can advantageously be fixed simply.

It is of particular advantage that the screw is formed as a shear-off head screw, so that, irrespective of the thickness of the cross section of the power cable, the screw is prevented from projecting beyond the outer circumference of the contact sleeve. In this case, the shear-off head screw is dimensioned such that the shear-off head shears off at a specific torque and the screw provides the required clamping force.

In order to simplify the insertion of the cable conductor into the contact sleeve, provision is advantageously made for each contact sleeve to have a cylindrical interior.

Particularly simple and secure locking of the contact sleeve is achieved by the locking device being formed as a spring ring which is arranged in a groove on the outer side of the contact sleeve and which expands into a notch formed in the inner wall of the cavity of the bush when the contact-making element is inserted into the cavity.

The fixing of the cable conductor in the contact sleeve is reinforced by the inner side of the contact sleeve being provided with internal grooving.

Brief Description of Drawings:

Further details, features and advantages of the present invention emerge from the following description with reference to the drawings, in which.

Figure 1:
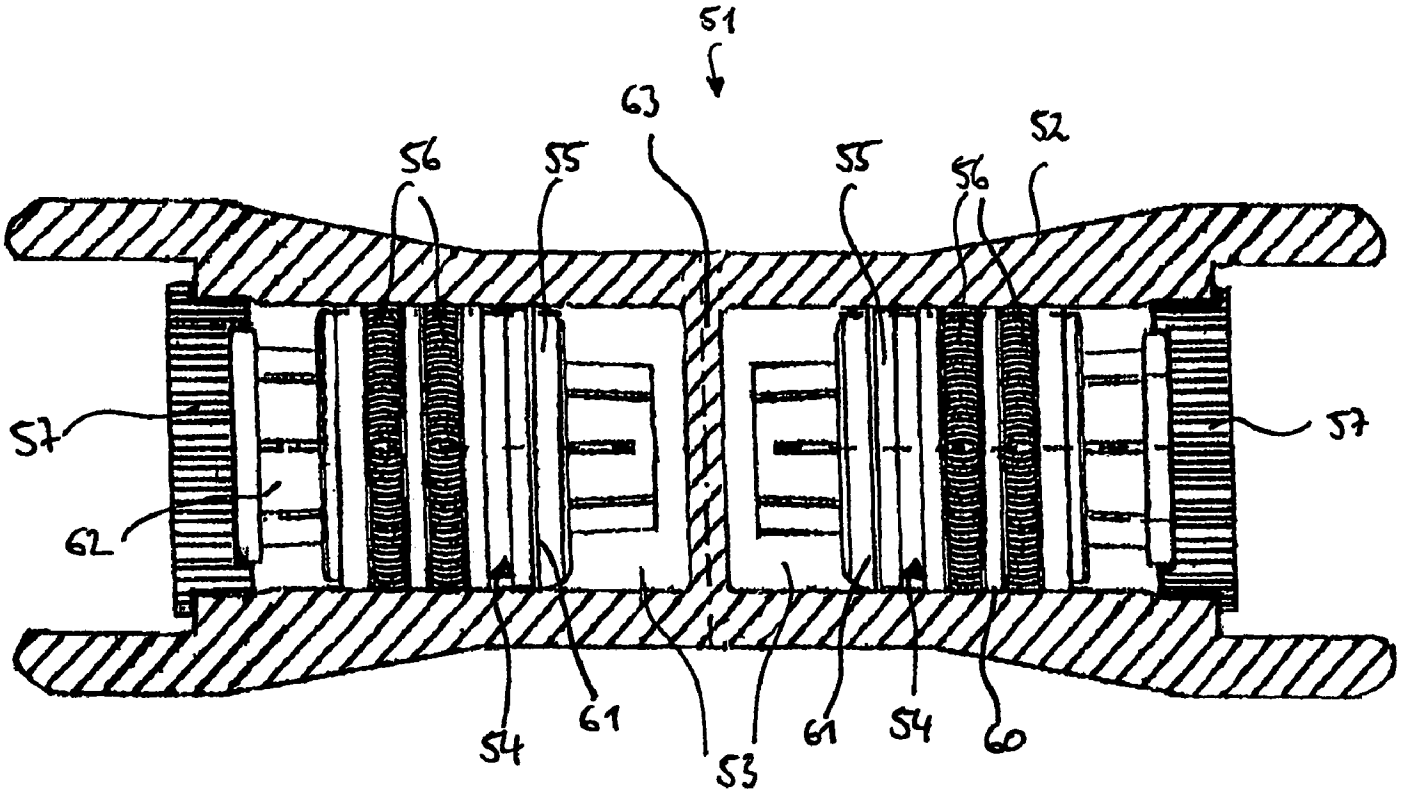
FIG. 1 illustrates a normal cable connecting device for power cables according to the previously known prior art in a cross section.
Figure 2:
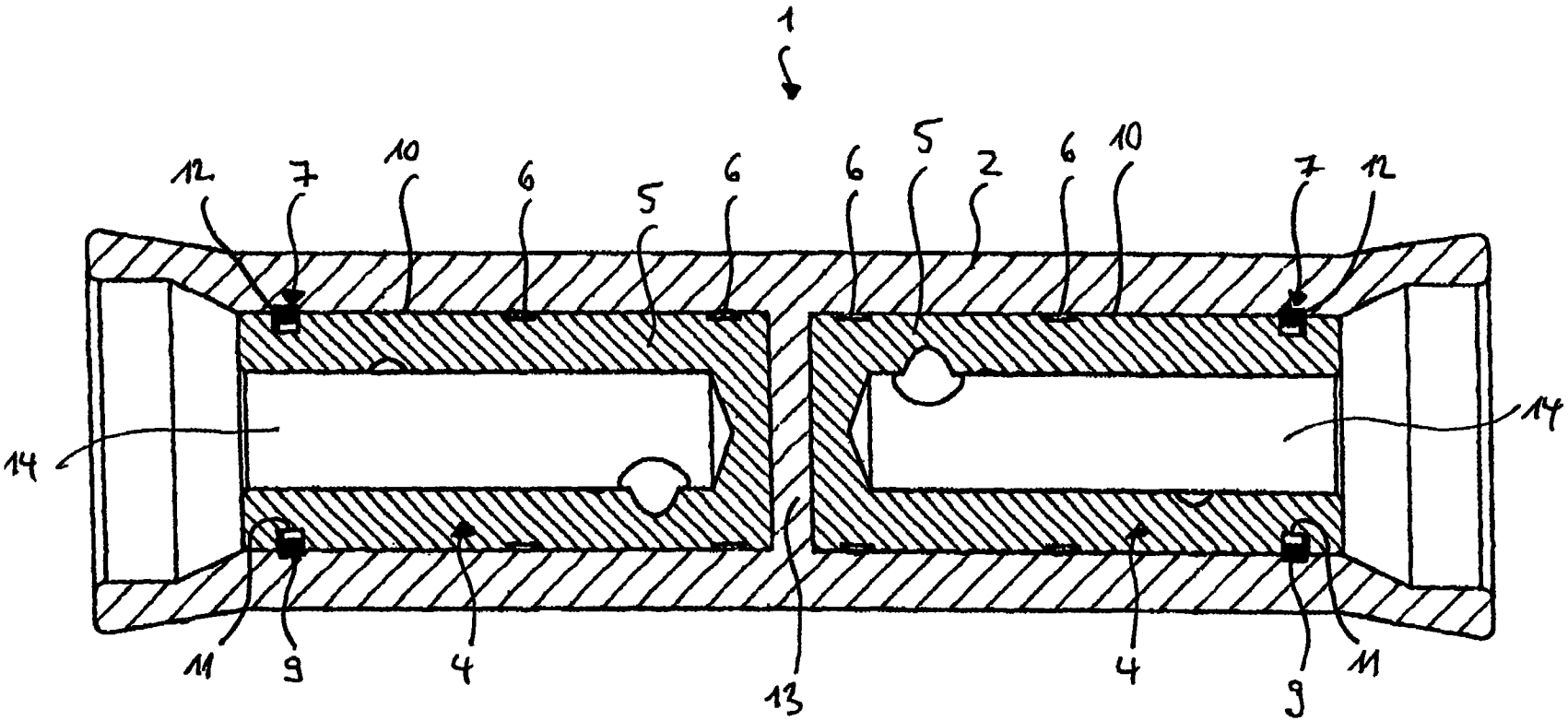
FIG. 2 shows a cable connecting device according to the invention in longitudinal sectional view.

Detailed Description:

The basic structure of the cable connecting device 1 according to the invention will be explained with reference to FIG. 2. The cable connecting device 1 in a preferred embodiment has a bush 2 in which two cavities 3 lying in a line are arranged one behind another. The two cavities 3 are cylindrical and separated from each other only by an intermediate wall 13 of the bush 2. Two contact-making elements 4, which are formed as contact sleeves 5, can be inserted into the cavities 3. The external diameter of the contact-making elements 4 is only slightly smaller than the internal diameter of the cylindrical cavities 3. The contact sleeves 5 have a cylindrical interior 14, into which the power cable (not shown) can be inserted and secured there, which will be described in still more detail further below.

The contact sleeves 5 in each case have a contact-making band, two contact-making bands 6 in the example illustrated, on their outer side 10, which compensate for tolerances and produce a secure electrical connection between contact sleeve 5 and electrically conductive bush 2 when the contact sleeve 5 is inserted into the cavity 3. Depending on the current intensity to be transmitted, even more contact-making bands 6 can also be provided. A locking device 7 serves to anchor the contact sleeve 5 in the bush 2. For this purpose, on the outer side 10 of the contact sleeve 5, preferably at its end oriented outward, a groove 11 is provided, in which there is a spring ring 9. In the assembled state, the latter expands into a notch 12 integrally molded on the inner wall of the cavity 3, at least part of the spring ring still remaining in the groove 11, so that simple and secure fixing of the contact sleeve 5 in the bush 2 is achieved.

Figure 3:
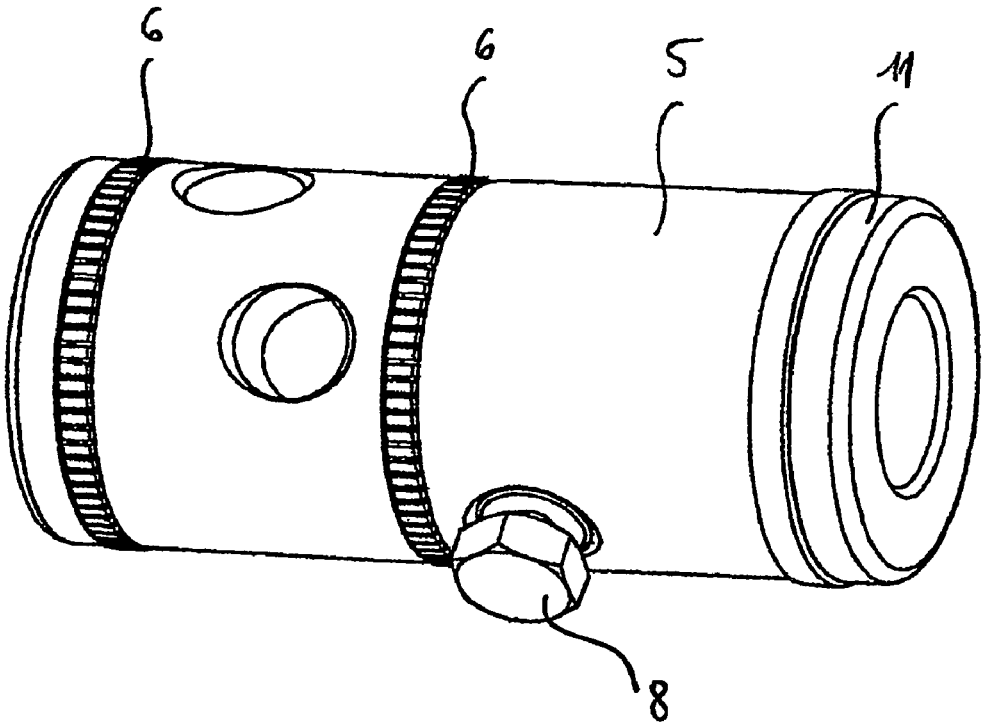
FIG. 3 shows a contact sleeve according to the invention in a perspective illustration.

In FIG. 3, an embodiment according to the invention of a contact sleeve 5 is illustrated perspectively. Clearly to be seen here are also the contact-making bands 6 on the outer side of the contact sleeve, and also a screw 8, preferably formed as a shear-off head screw, which can be screwed into the circumferential wall of the contact sleeve 5, by which means the power cable is fixed securely in the contact sleeve. If normal screws are used, it is important that the screw head is countersunk completely into the circumferential wall of the contact sleeve 5, since otherwise insertion of the contact sleeve 5 into a cavity 3 of the bush 2 is not possible.

In order also to be able to fixed conductors with a smaller conductor cross section and any desired geometric cross-sectional shape securely in the contact sleeve 5, it is also possible, as indicated by the screw holes in FIG. 3, to arrange a plurality of screws at different points of the circumference of the contact sleeve. In this case, it is advantageous if the screws are pressed onto the power cable from different angles but also from a main direction.

Figure 4:
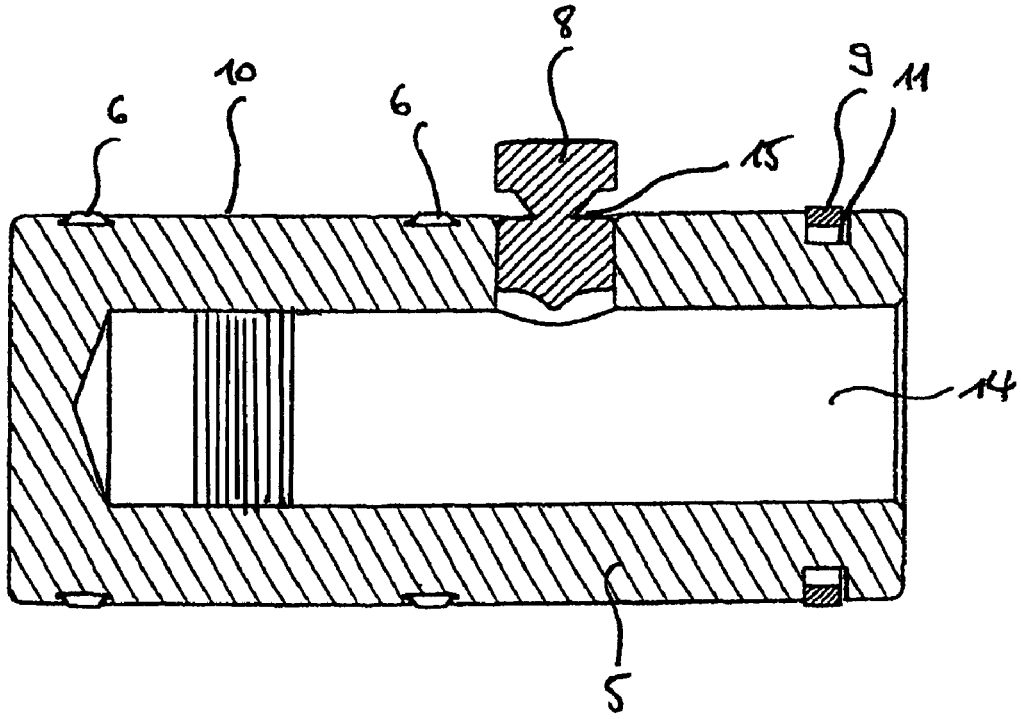
FIG. 4 shows a longitudinal section through the contact sleeve from FIG. 3.

FIG. 4 illustrates a cross section of the contact sleeve 5 from FIG. 3 when a shear-off head screw 8 is used. The boundary walls of the interior 14 of the contact sleeve 5 can be provided with internal grooving for better fixing of the inserted power cable.

Once the power cable has been inserted into the interior 14, the shear-off head screw is tightened until a predetermined torque is exceeded and the head of the screw is severed at an intended fracture point 15. After that, the contact sleeve 5 is inserted into the cavity 3 of the bush 2 until its front end strikes the central web 13 of the bush 2. In this position, the spring ring 9 expands into the notch 12 and fixes the contact sleeve 5 in the bush 2. Thus, via the shear-off head screw 8, contact sleeve 5, the contact-making bands 6 and the electrically conductive bush 2, a secure conductive connection between two power cables is produced without additional tools having to be used.

The exact position of the contact-making bands, the locking device and the type of shear-off head screw used in this case can be selected differently, depending on the intended use.

The invention claimed is:

1. A cable connecting device for fixing power cables and for producing an electrical connection between power cables, said cable connecting device comprising a bush which has at least two cylindrical cavities into which in each case a contact-making element can be inserted, which has a contact sleeve serving to accommodate one end of a power cable and having contact-making bands on its outer side and has a locking device which, after the contact sleeve has been inserted into the cavity, secures said contact sleeve in its place;

it being possible for the power cable to be electrically conductively connected to the contact sleeve and clamped in the latter by means of at least two screws on the outer side which can be screwed into the circumferential wall of the contact sleeve, wherein the screws are distributed over the outer circumference of the contact sleeve along an imaginary spiral in such a way that they can be screwed onto the power cable at different angles around a central longitudinal axis of said sleeve relative to one another.

2. The cable connecting device according to claim 1, wherein the screw is formed as a shear-off head screw.

3. The cable connecting device according to claim 1, wherein each contact sleeve has a cylindrical interior.

4. The cable connecting device according to claim 1, wherein the locking device is formed as a spring ring which is arranged in a groove on the outer side of the contact sleeve and which expands into a notch formed in the inner wall of the cavity of the bush when the contact-making element is inserted into the cavity.

5. The cable connecting device according to claim 1, wherein the inner side of the contact sleeve is provided with internal grooving.

6. A cable connecting device for fixing power cables and for producing an electrical connection between power cables, said cable connecting device comprising a bush which has at least two cylindrical cavities into which in each case a contact-making element can be inserted, which has a contact sleeve serving to accommodate one end of a power cable and having contact-making bands on its outer side and has a locking device which, after the contact sleeve has been inserted into the cavity, secures said contact sleeve in its place;

it being possible for the power cable to be electrically conductively connected to the contact sleeve and clamped in the latter by means of at least two screws on the outer side which can be screwed into the circumferential wall of the contact sleeve, wherein the screws are distributed over the outer circumference of the contact sleeve in such a way that they can be screwed onto the power cable at different angles around, and along a center of symmetry of, a central longitudinal axis of said sleeve relative to one another.

7. The cable connecting device according to claim 6, wherein the screw is formed as a shear-off head screw.

8. The cable connecting device according to claim 6, wherein each contact sleeve has a cylindrical interior.

9. The cable connecting device according to claim 6, wherein the locking device is formed as a spring ring which is arranged in a groove on the outer side of the contact sleeve and which expands into a notch formed in the inner wall of the cavity of the bush when the contact-making element is inserted into the cavity.

10. The cable connecting device according to claim 6, wherein the inner side of the contact sleeve is provided with internal grooving.

11. A cable connecting device for fixing power cables and for producing an electrical connection between power cables, said cable connecting device comprising a bush which has at least two cylindrical cavities into which in each case a contact-making element can be inserted, which has a contact sleeve serving to accommodate one end of a power cable and having contact-making bands on its outer side and has a locking device which, after the contact sleeve has been inserted into the cavity, secures said contact sleeve in its place;

it being possible for the power cable to be electrically conductively connected to the contact sleeve and clamped in the latter by means of at least first and second screws on the outer side which can be screwed into the circumferential wall of the contact sleeve, wherein the screws are distributed over the outer circumference of the contact sleeve such that a first axis along the length of said first screw forms an angle with respect to a second axis along the length of said second screw, wherein the first screw and the second screw are separated along a longitudinal axis of said contact sleeve.

12. The cable connecting device according to claim 11, wherein the screw is formed as a shear-off head screw.

13. The cable connecting device according to claim 11, wherein each contact sleeve has a cylindrical interior.

14. The cable connecting device according to claim 11, wherein the locking device is formed as a spring ring which is arranged in a groove on the outer side of the contact sleeve and which expands into a notch formed in the inner wall of the cavity of the bush when the contact-making element is inserted into the cavity.

15. The cable connecting device according to claim 11, wherein the inner side of the contact sleeve is provided with internal grooving.

* * * * *